US010060185B2

(12) United States Patent
Kinkade

(10) Patent No.: US 10,060,185 B2
(45) Date of Patent: Aug. 28, 2018

(54) CONCEALABLE STEP STOOL

(71) Applicant: Darla Kinkade, Eugene, OR (US)

(72) Inventor: Darla Kinkade, Eugene, OR (US)

( * ) Notice: Subject to any disclaimer, the term of this patent is extended or adjusted under 35 U.S.C. 154(b) by 0 days.

(21) Appl. No.: 14/886,239

(22) Filed: Oct. 19, 2015

(65) Prior Publication Data

US 2016/0108669 A1 Apr. 21, 2016

Related U.S. Application Data

(60) Provisional application No. 62/065,900, filed on Oct. 20, 2014.

(51) Int. Cl.

| | |
|---|---|
| ***E06C 1/00*** | (2006.01) |
| ***A47B 97/00*** | (2006.01) |
| *A47B 77/10* | (2006.01) |

(52) U.S. Cl.

CPC ..... *E06C 1/005* (2013.01); *A47B 97/00* (2013.01); *A47B 77/10* (2013.01); *A47B 2220/05* (2013.01)

(58) Field of Classification Search

CPC ..... E06C 1/005; A47B 97/00; A47B 77/10; A47B 2220/05; A47L 3/02

See application file for complete search history.

(56) References Cited

U.S. PATENT DOCUMENTS

| | | | | |
|---|---|---|---|---|
| 1,017,239 A * | 2/1912 | Ackerman | A47B 77/10 | 312/290 |
| 2,628,659 A * | 2/1953 | Carpenter | A47B 83/02 | 190/8 |
| 3,481,429 A * | 12/1969 | Gaede | E06C 1/005 | 182/129 |
| 3,833,089 A | 9/1974 | Backwell | | |
| 4,155,423 A * | 5/1979 | Miller | A47C 13/00 | 182/33 |
| 4,463,826 A * | 8/1984 | Pearce | B64F 1/224 | 108/129 |
| 5,085,290 A | 2/1992 | Guirlinger | | |
| 5,341,897 A * | 8/1994 | Gross | A47B 77/10 | 182/35 |
| 5,529,374 A * | 6/1996 | Wimberly, Jr. | A47C 1/08 | 297/195.12 |
| 6,752,456 B1 * | 6/2004 | Latham | A47C 9/00 | 297/217.7 |
| 6,880,673 B1 * | 4/2005 | Harris | A47B 97/00 | 182/35 |
| 2,547,808 A1 * | 4/2006 | Burrage | E04H 1/14 | 108/33 |

(Continued)

FOREIGN PATENT DOCUMENTS

| | | | | |
|---|---|---|---|---|
| DE | 102012108206 A1 * | 3/2013 | ..... | A47B 5/00 |
| DE | 102012108206 A1 * | 3/2013 | ..... | A47B 5/00 |

(Continued)

*Primary Examiner* — Katherine W Mitchell
*Assistant Examiner* — Candace L Bradford
(74) *Attorney, Agent, or Firm* — Global Intellectual Property Agency, LLC; Jordan Sworen

(57) ABSTRACT

A stool that can be concealed underneath a cabinet. The present invention includes a housing plate with tracks that facilitate the movement of a footplate. The footplate is attached to the housing plate such that the footplate can either be perpendicular or parallel to the face of the cabinet. When the footplate moves from the perpendicular position to the parallel position, it locks into place, providing a secure step.

5 Claims, 5 Drawing Sheets

(56) References Cited

U.S. PATENT DOCUMENTS

| | | | | |
|---|---|---|---|---|
| 7,025,365 | B2 * | 4/2006 | Bang | B60R 3/02 280/163 |
| 2004/0251080 | A1 * | 12/2004 | Kalos | E06C 1/005 182/35 |
| 2009/0188754 | A1 | 7/2009 | Warren et al. | |
| 2012/0086317 | A1 | 4/2012 | Baran | |
| 2013/0186709 | A1 | 7/2013 | White | |
| 2013/0213738 | A1 * | 8/2013 | Schroeder | E06C 9/06 182/90 |
| 2015/0001005 | A1 * | 1/2015 | Goodson | E06C 1/005 182/96 |

FOREIGN PATENT DOCUMENTS

| | | | | |
|---|---|---|---|---|
| DE | 202014104314 | U1 * | 9/2014 | A47B 77/10 |
| DE | 202014104314 | U1 * | 9/2014 | A47B 77/10 |

* cited by examiner

CONCEALABLE STEP STOOL

CROSS REFERENCE TO RELATED APPLICATIONS

This application claims the benefit of U.S. Provisional Application No. 62/065,900 filed on Oct. 20, 2014. The above identified patent application is herein incorporated by reference in its entirety to provide continuity of disclosure.

FIELD OF THE INVENTION

The present invention relates to step stools. More specifically, the present invention relates to a deployable step stool that can be concealed underneath a cabinet.

BACKGROUND OF THE INVENTION

Presently, there are various configurations of step stools known in the art that allow individuals of a lesser height to access items and spaces that would otherwise be unreachable. A common configuration of a step stool is a platform with four legs. The step stool must be transported to the location where the user needs to access an unreachable space. This requires that there be enough surface space to place the step stool beneath the area the user is seeking to reach.

Further, step stools configured in this manner require a storage space that is at least the size of the step stool. This is not only inconvenient, but may also cause damage to walls, floors, or cabinets where the user chooses to store the step stool. These step stools also require users to grasp the stool with their hands, which is less sanitary, especially in kitchen, bathroom, and restaurant settings. Therefore, there is a need for a step stool that can be quickly stored without taking up unnecessary space and causing damage to its surroundings. There is also a need for a step stool that a user can employ without the use of his or her hands.

Current devices that foldaway into cabinets or retract therefrom are cumbersome, visible and aesthetically unpleasing, or require the use of hands. Additionally, some of these devices require the user to purchase and install a specific cabinet manufactured with the step stool. Therefore, there is a need for a concealable step stool that can be installed beneath the user's existing cabinetry.

SUMMARY OF THE INVENTION

In view of the foregoing disadvantages inherent in the known types of step stools now present in the prior art, the present invention provides a convenient deployable aid that the user can step onto in order to gain access to spaces or items above the vertical reach of the user. The present system comprises a housing plate that can be bolted to the floor, inner cabinet walls, or other support surfaces. The housing plate has hinges, pins, and springs positioned along its tracks. A footplate is mounted to the housing plate by a hinged connector. The connector is rounded thus providing a secure step when the footplate falls backward from a first position wherein the footplate is perpendicular to the housing plate, to a second position wherein the footplate is parallel above the housing plate.

In an alternative embodiment, the housing plate is configured to move through sliders powered by a motor module. The housing plate is attached to a footplate that is perpendicular to the housing plate at the first position. The user first activates the motor module thereby releasing the housing plate from the sliders. The housing plate moves through the tracks and rotates the footplate to the second position parallel above the housing plate.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
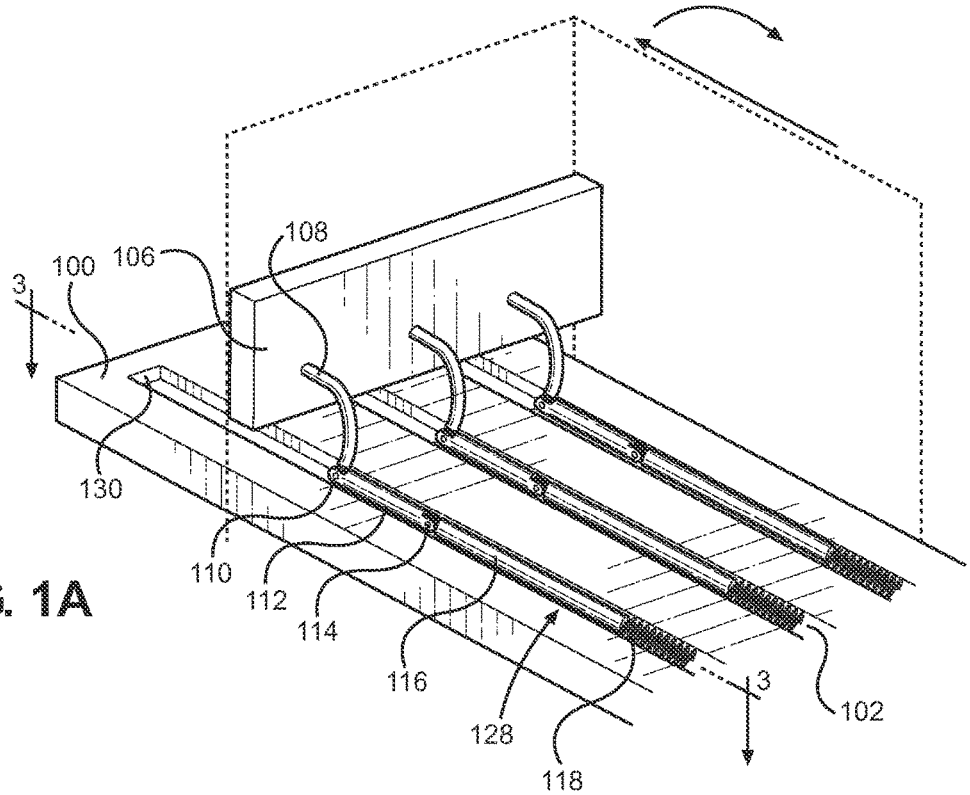
FIG. 1A shows a perspective view of the present invention in the first position.

Reference is made herein to the attached drawings. Like reference numerals are used throughout the drawings to depict like or similar elements of the step stool. For the purposes of presenting a brief and clear description of the present invention, the preferred embodiment will be discussed as used for manually releasing a step from beneath a cabinet. The figures are intended for representative purposes only and should not be considered to be limiting in any respect.

The present invention is a deployable step aid that may be attached to a support surface. Examples of support surfaces include floors, walls, and cabinetry. In one embodiment, a housing plate is bolted to the floor beneath a cabinet. A footplate is hingedly connected to the housing plate. In the first position, the footplate is perpendicular to the housing plate and appears to be part of the face of the cabinet or other support surface. From the first position, a user may deploy the aid by pushing against the footplate, depressing a lever, or pushing an activation button linked to a motor module.

In one embodiment, where the aid is deployed by pushing against the footplate, a spring assembly propels the footplate outward from the face of the cabinet. As the springs continue to extend, the footplate rotates backwardly into a second position parallel above the housing plate. In this position, the user can step onto the footplate for use as a step stool.

Figure 1B:
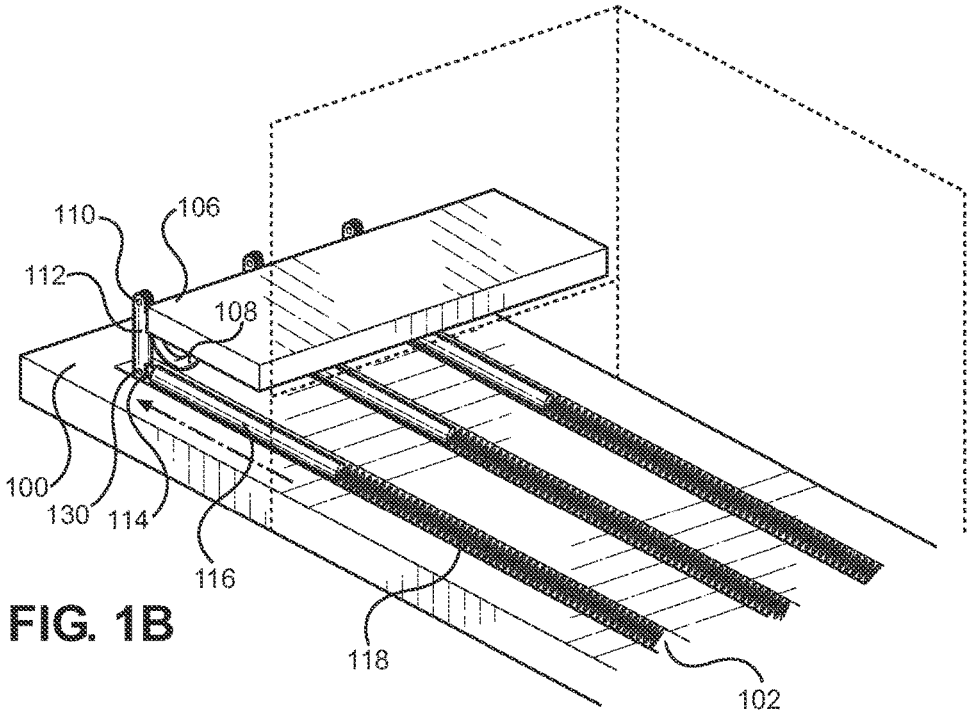
FIG. 1B shows a perspective view of the present invention in the second position.

Referring now to FIGS. 1A-1B, there are shown perspective views of the present invention in the first position and the second position. In the depicted embodiment, there is a housing plate 100 connected to a footplate 106 by a rounded connector 108. The connector 108 is attached to a spring assembly 128 positioned along a track 102 on the housing plate 100. The spring assembly 128 includes a first pin 112, a second pin 116, and a spring 118 connected in series. The connector 108 is attached to the first pin 112 of the spring assembly 128 at the first hinge 110. The first pin 112 is further connected on the opposing end to the second pin 116 via the second hinge 114. The second pin 116 is further connected on the opposing end to the spring 118. In the first position, the springs 118 are compressed and the footplate 106 is flush with the face of a cabinet, as shown in FIG. 1A.

When the depicted embodiment of the present invention is activated, the spring 118 exerts a horizontal force on the linkage of the first pin 112 and the second pin 116, pushing the second pin 116 forward. As the second pin 116 is pushed forward, the first pin 112 is likewise forced forward thereby. The first pin 112 moves horizontally until it reaches an upward curve 130 at the distal end of the track 102. The force exerted by the spring 118 pushes the first pin 112 up the curve until it rotates into a vertical position via the second hinge 112. When the first pin 112 rotates upwardly, the connector 108 then rotates backwardly via the first hinge 110, moving the footplate 106 from the first position perpendicular to the housing plate 100 to the second position parallel above the housing plate 100. The arrangement of the first pin 112 in the vertical position and the connector 108 resting on the second pin 116 secures the footplate 106 in place while providing a step for the user, as shown in FIG. 1B.

Figure 2:
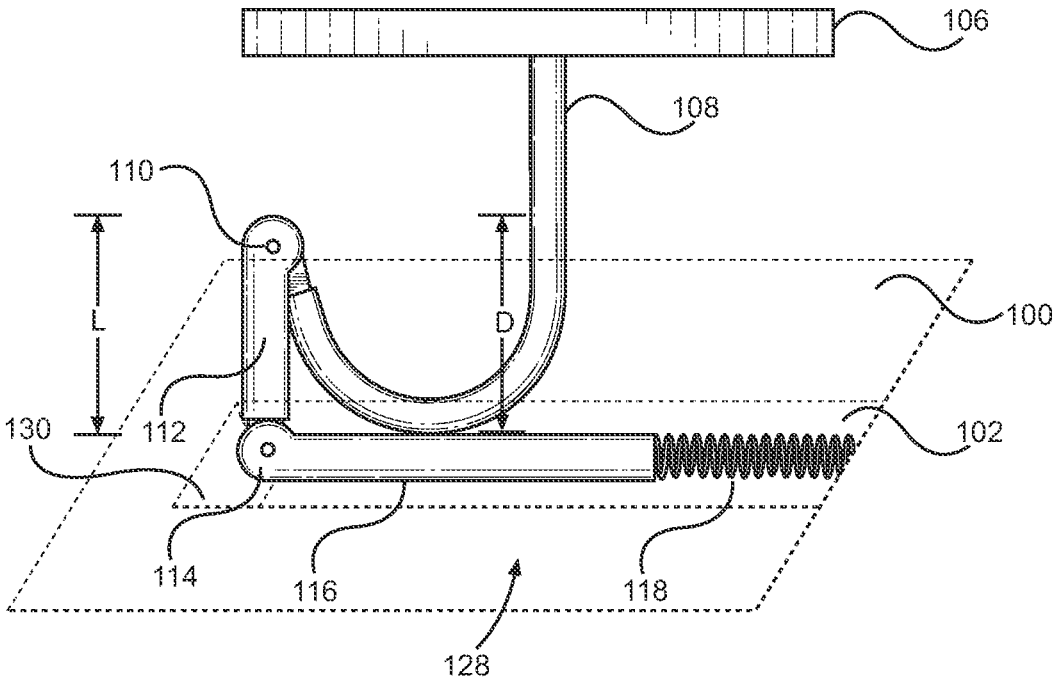
FIG. 2 shows a schematic view of the footplate and housing plate connections in the second position.

Referring now to FIG. 2, there is shown a schematic view of the footplate and housing plate connections in the second position. In the depicted embodiment, the connector 108 has a straight section and a rounded section. The rounded section has a depth "D." When "D" is equal to length "L," the length of the first pin 112, the rounded section can rest on the second pin 116 when the connector 108 rotates backward. The ability of the connector 108 to rest on second pin 116 provides a secure step because the force of the user's weight pushes down on the connector 108, which in turn exerts pressure on the second pin 116 in the track 102 of the housing plate 100. Also in the depicted embodiment, the first pin 112 is shorter than the second pin 116. This allows for the depth of the rounded section of the connector 108 to equal the length of the first pin 112, while still providing enough space for the connector 108 to rest solely on the second pin 116 without exerting pressure on the spring 118.

Figure 3:
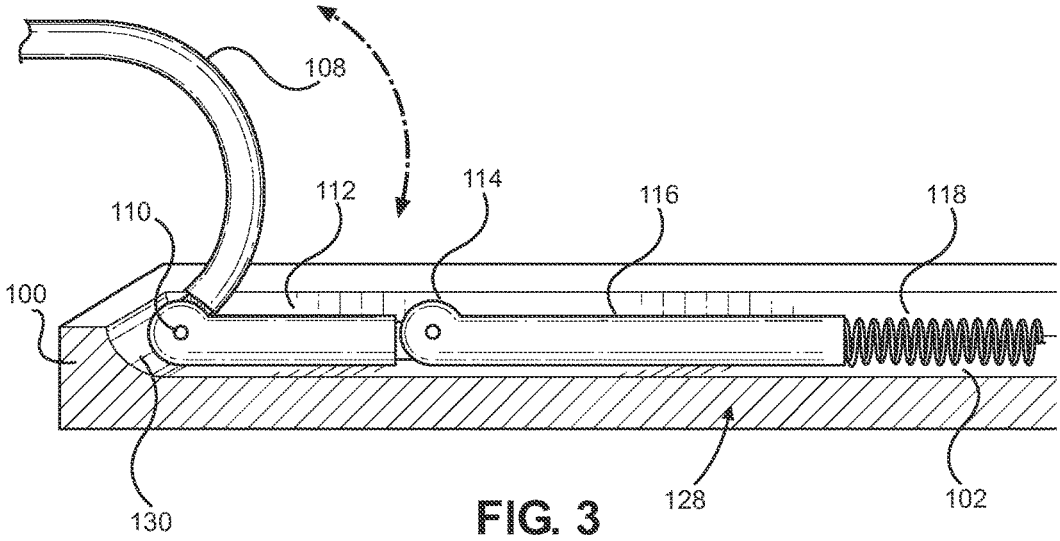
FIG. 3 is a cross-sectional view of the present invention in the first position along line 3-3.

Referring now to FIG. 3 there is shown a cross-sectional view of the present invention in the first position. In the depicted embodiment, the track 102 has an upward curve 130 at the distal end. When the force of the spring 118 pushes the second pin 116 forward, it pushes the first pin 112 up the curve in the track 102. The first pin 112 moves into a vertical position and the connector 108 falls back onto the second pin 116.

Figure 4:
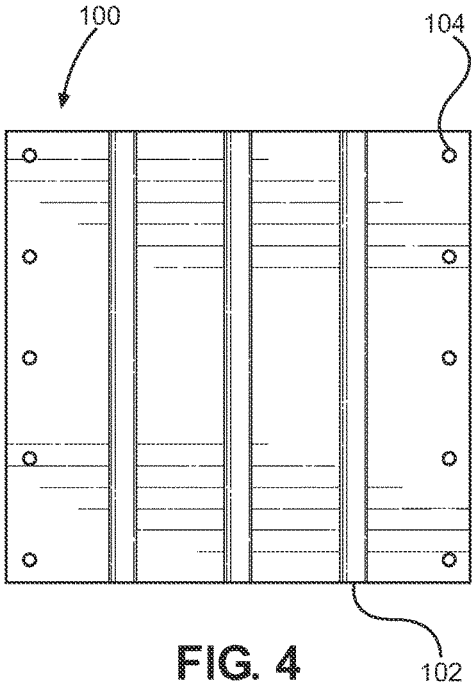
FIG. 4 shows a perspective view of the housing plate.

Referring now to FIG. 4, there is shown a perspective view of the housing plate. In the depicted embodiment, the housing plate 100 of the present invention comprises a track 102. The spring assembly 128 is positioned along the track 102. In the depicted embodiment, the housing plate can be connected to the floor using bolts 104. In various embodiments, the housing plate 100 can be additionally or exclusively connected to the inner cabinet walls or any other support surface.

Figure 5A:
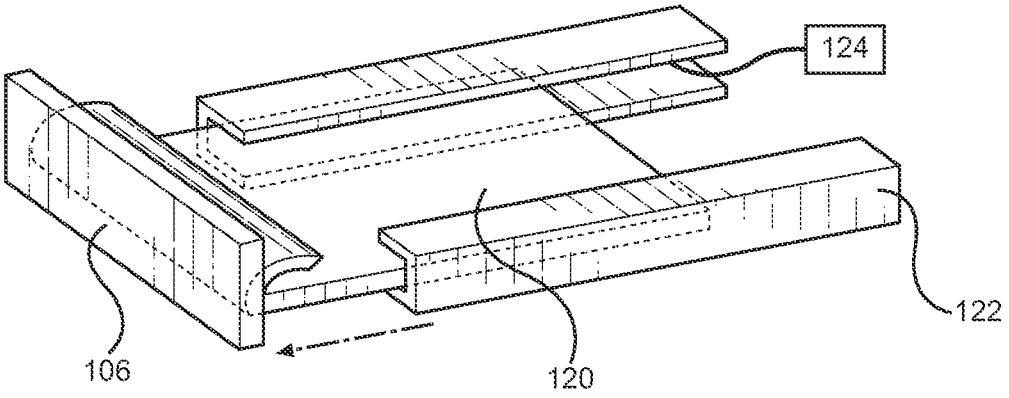
FIG. 5A shows a schematic view of an alternative embodiment of the present invention.
Figure 5B:
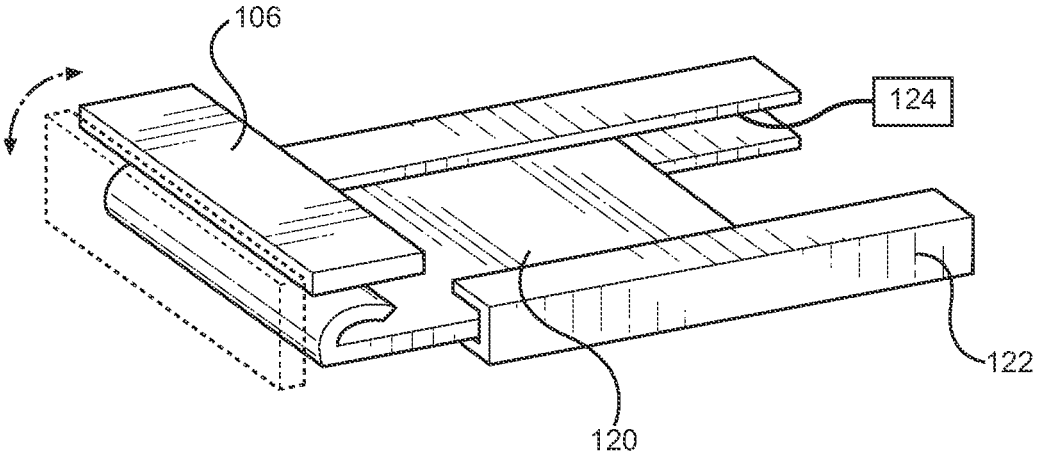
FIG. 5B shows a schematic view of an alternative embodiment of the present invention.

Referring now to FIGS. 5A and 5B, there are shown schematic views of an alternative embodiment of the present invention. In the depicted embodiment, the movement of the housing plate 120 and the footplate 106 is controlled by a motor module 124. Sliders 122 can be secured to the floor, inner cabinet walls, or any other support surface. The sliders 122 are configured to release a housing plate 120. The housing plate 120 is attached to the footplate 106. When the housing plate 120 moves through the sliders 122, it rotates the footplate 106 to the second position parallel above the housing plate 120.

Figure 6A:
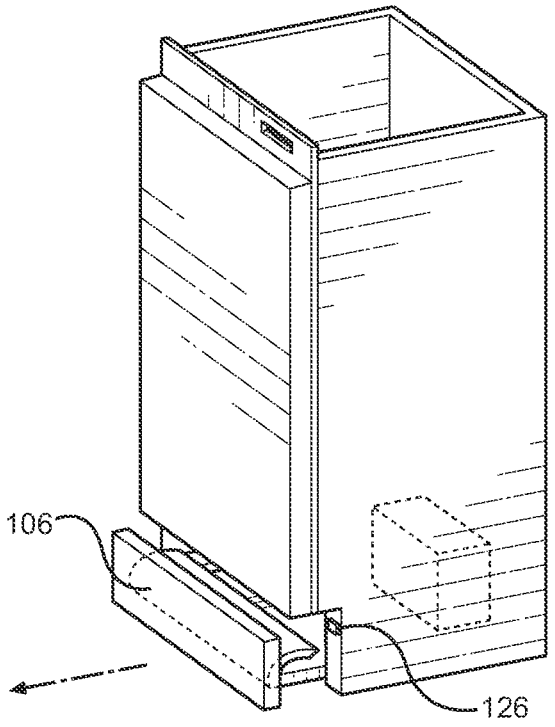
FIG. 6A shows a schematic view of the embodiment of the present invention shown in FIGS. 5A and 5B in use beneath a cabinet.
Figure 6B:
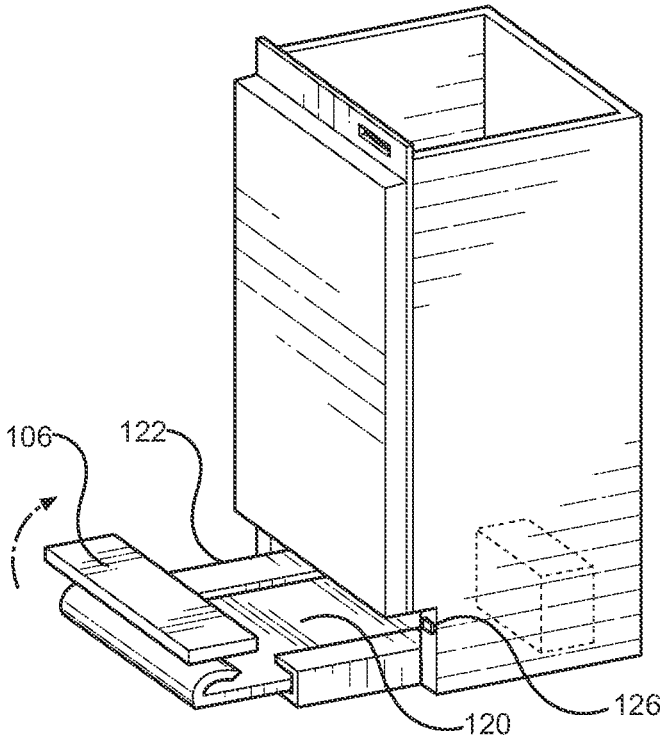
FIG. 6B shows a schematic view of the embodiment of the present invention shown in FIGS. 5A and 5B in use beneath a cabinet.

Referring now to FIGS. 6A and 6B, there are shown schematic views of the embodiment of the present invention shown in FIG. 5 in use beneath a cabinet. The depicted embodiment shows an activation button 126 at either the foot level or counter level that is operably connected to the motor module 124. When activated, the motor module 124 releases the housing plate 120 from the sliders 122 beneath the cabinet and rotates the footplate 106 from the first position perpendicular to the housing plate 120 to the second position parallel above the housing plate 120.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A step, comprising:

a housing plate attached to a support surface, the housing plate comprising a track;

a footplate;

a spring assembly disposed along the track, the spring assembly comprising a J-shaped connector having a first end, a second end, wherein the first and second ends extend in different directions from an apex that is formed therebetween, wherein the first end comprises a greater length than the second end;

wherein the J-shaped connector is attached to the footplate at the first end, a first pin hingedly connected to the J-shaped connector at the second end, a second pin hingedly connected to the first pin, and a spring connecting the second pin to the housing plate;

wherein movement of the spring assembly along the track forces the housing plate to slide outward and rotates the footplate from a first position perpendicular to the housing plate to a second position parallel above the housing plate;

wherein the apex of the J-shaped connector rests on the second pin in the second position.

2. The step of claim 1, wherein the J-shaped connector comprises a rounded section disposed between the first end and the second end.

3. The step of claim 2, wherein a depth of the rounded section of the J-shaped connector is equal to a length of the first pin.

4. The step of claim 1, wherein the first pin is perpendicular to the second pin in the second position.

5. The step of claim 1, wherein the spring, the first pin, and the second pin are axially aligned when the footplate is in the first position.

* * * * *